US010323473B2

(12) United States Patent
Magnuson et al.

(10) Patent No.: US 10,323,473 B2
(45) Date of Patent: Jun. 18, 2019

(54) MODULAR RACKER SYSTEM FOR A DRILLING RIG

(71) Applicant: Nabors Industries, Inc., Houston, TX (US)

(72) Inventors: Christopher Magnuson, Houston, TX (US); Pedrag Radovanovic, Belgrade (RS); Miodrag Djuric, Belgrade (RS)

(73) Assignee: NABORS INDUSTRIES, INC., Houston, TX (US)

( * ) Notice: Subject to any disclaimer, the term of this patent is extended or adjusted under 35 U.S.C. 154(b) by 651 days.

(21) Appl. No.: 14/565,561

(22) Filed: Dec. 10, 2014

(65) Prior Publication Data

US 2016/0168929 A1 Jun. 16, 2016

(51) Int. Cl.

| | |
|---|---|
| ***E21B 19/14*** | (2006.01) |
| ***E21B 19/20*** | (2006.01) |
| ***E21B 19/08*** | (2006.01) |
| ***E21B 19/083*** | (2006.01) |
| ***E21B 19/00*** | (2006.01) |

(52) U.S. Cl.

CPC ..... *E21B 19/14* (2013.01); *E21B 19/00* (2013.01); *E21B 19/08* (2013.01); *E21B 19/083* (2013.01); *E21B 19/20* (2013.01)

(58) Field of Classification Search

CPC ..... E21B 19/00; E21B 19/08; E21B 19/083; E21B 19/14; E21B 19/20

See application file for complete search history.

(56) References Cited

U.S. PATENT DOCUMENTS

| | | | | |
|---|---|---|---|---|
| 2,937,008 | A | 5/1960 | Whittle | |
| 3,802,137 | A | 4/1974 | Armstrong | |
| 3,978,993 | A | 9/1976 | Howard | |
| 4,109,800 | A | 8/1978 | Howard et al. | |
| 4,221,088 | A | 9/1980 | Patterson | |
| 4,578,911 | A | 4/1986 | Hashimoto | |
| 4,765,401 | A * | 8/1988 | Boyadjieff | E21B 19/20 166/77.53 |
| 4,791,999 | A | 12/1988 | Skeie | |

(Continued)

OTHER PUBLICATIONS

Risholt, Rune, et al. WO 2014/177498. Machine for Manipulating Pipes.*

(Continued)

*Primary Examiner* — Nicole Coy
*Assistant Examiner* — Tara E Schimpf
(74) *Attorney, Agent, or Firm* — Haynes and Boone, LLP

(57) ABSTRACT

The systems, devices, and methods described herein relate to a modular racker system for a drilling rig. The modular racker includes transportable modules including a lower track module comprising a drilling rig floor that includes a lower track arranged and configured to accommodate a lower carriage. The lower track is permanently fixed to the drilling rig floor so as to form a part of the drilling rig floor and is transportable as part of the drilling rig floor. An upper track module comprises a fingerboard and an upper track arranged and configured to accommodate an upper carriage moveable along the upper track. The upper track is permanently fixed to the fingerboard and is transportable in a connected configuration. The lower and upper track modules are attachable to a racker column module.

23 Claims, 10 Drawing Sheets

(56) References Cited

U.S. PATENT DOCUMENTS

| | | | | |
|---|---|---|---|---|
| 4,813,493 | A | 3/1989 | Shaw et al. | |
| 4,899,959 | A | 2/1990 | Weiler | |
| 5,244,329 | A | 9/1993 | McGill et al. | |
| 5,437,527 | A | 8/1995 | McGill et al. | |
| 5,921,329 | A | 7/1999 | Armstrong | |
| 6,056,071 | A | 5/2000 | Scott et al. | |
| 6,561,155 | B1 | 5/2003 | Williams | |
| 6,725,949 | B2 | 4/2004 | Seneviratne | |
| 6,821,071 | B2 | 11/2004 | Woolslayer et al. | |
| 7,246,983 | B2 | 7/2007 | Zahn et al. | |
| 7,270,189 | B2 | 9/2007 | Brown et al. | |
| 7,401,664 | B2 | 7/2008 | Wells et al. | |
| 7,500,531 | B2 | 3/2009 | Williams et al. | |
| 7,673,675 | B2 | 3/2010 | Carr et al. | |
| 7,699,122 | B2 * | 4/2010 | Eriksen | E21B 19/14 175/52 |
| 7,743,853 | B2 | 6/2010 | Rudshaug et al. | |
| 7,748,473 | B2 | 7/2010 | Wells et al. | |
| 7,828,085 | B2 | 11/2010 | Kuttel et al. | |
| 7,828,087 | B2 | 11/2010 | Vora | |
| 8,151,909 | B2 | 4/2012 | Kuttel et al. | |
| 8,181,697 | B2 * | 5/2012 | Springett | E21B 15/003 166/313 |
| 8,499,858 | B2 | 8/2013 | Kuttel et al. | |
| 8,839,884 | B2 | 9/2014 | Kuttel et al. | |
| 2004/0057815 | A1 * | 3/2004 | Woolslayer | E21B 19/14 414/22.63 |
| 2005/0279507 | A1 | 12/2005 | Folk et al. | |
| 2006/0096751 | A1 | 5/2006 | Brown et al. | |
| 2007/0039758 | A1 | 2/2007 | Klipstein | |
| 2007/0140801 | A1 | 6/2007 | Kuttel et al. | |
| 2007/0209878 | A1 | 9/2007 | Czechowski et al. | |
| 2007/0240908 | A1 | 10/2007 | Brown et al. | |
| 2008/0164084 | A1 | 7/2008 | Belik et al. | |
| 2010/0141231 | A1 | 6/2010 | Duchene | |
| 2010/0303586 | A1 * | 12/2010 | Hankins | E21B 19/14 414/22.51 |
| 2010/0326672 | A1 | 12/2010 | Childers et al. | |
| 2012/0160570 | A1 | 6/2012 | Kuttel et al. | |
| 2014/0202789 | A1 | 7/2014 | Magnuson | |

OTHER PUBLICATIONS

International Search Report and Written Opinion dated Feb. 1, 2016 in connection with International Patent Application No. PCT/US2015/060375; 17 pp.

ISA/US, International Search Report and Written Opinion of the International Searching Authority, PCT/US2006/62414, dated Oct. 15, 2007, 8 pages.

WIPO, International Preliminary Report on Patentability, PCT/US2006/62414, dated Jun. 24, 2008, 6 pages.

European Patent Office, European Search Report dated Feb. 27, 2012, Application No. 06846724.0-1266/1984137 PCT/US2006062414, 7 pages.

Vengineer.com, "Fast Land Rig Designed for Drilling Contractors & Rig Movers" http://vengineer.com/land-rig.html, visited Feb. 19, 2015, 2 pages.

* cited by examiner

MODULAR RACKER SYSTEM FOR A DRILLING RIG

TECHNICAL FIELD

The present disclosure is directed to systems, devices, and methods for efficiently assembling and disassembling at least a portion of a drilling rig. More specifically, the present disclosure is directed to systems, devices, and methods utilizing a modular column pipe racker system on a drilling rig that may be efficiently assembled or disassembled.

BACKGROUND OF THE DISCLOSURE

The exploration and production of hydrocarbons require the use of numerous types of tubulars also referred to as pipes. Tubulars include, but are not limited to, drill pipes, casings, tubing, risers, and other threadably connectable elements used in well structures. The connection of "strings" of joined tubulars or "drill strings" is often used to drill a wellbore and, with regards to casing, prevent collapse of the wellbore after drilling. These tubulars are normally assembled in groups of two or more commonly known as "stands."

Tubular handling systems, also known as racker systems, on drilling rigs are often used to receive tubulars, manipulate them about the rig, assist in the makeup or breakdown of tubular stands, introduce them for connection into the drill string, receive them from the drill string, and perform other tubular manipulations. These racker systems can be large, complex structures with many components and parts that enable them to move the stands to a desired location and to vertically store them in the derrick or mast. The derrick or mast may include a storing structure commonly referred to as a fingerboard. Fingerboards typically include a plurality of horizontally elongated support structures or "fingers" each capable of receiving a plurality of stands.

Land-based mobile drilling rigs are utilized to drill wells at a first location, and then are often moved to a new second location to drill additional wells. The time period for tearing down a rig, transporting it and setting it up in a new location can vary between days and weeks. However, any downtime of the drilling rig results in high costs with little return. In order to minimize this loss in potential revenue, efficient rig tear down and setup are desirable. Current column pipe racker assemblies are not utilized on the land-based mobile drilling rigs and are confined to permanent drilling rig installations in the offshore. Because of their many large components and pieces, their installation requires the use of many cranes and take a relatively large amount of time. The large components, complex installation requirements and lengthy time for installation result in column rackers utilized on fixed drilling installations and Mobile Offshore Drilling Units (MODU). What is needed is a racker system that is more easily torn down and setup and designed to work with land-based mobile drilling rigs.

The present disclosure is directed to systems and methods that overcome one or more of the shortcomings of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
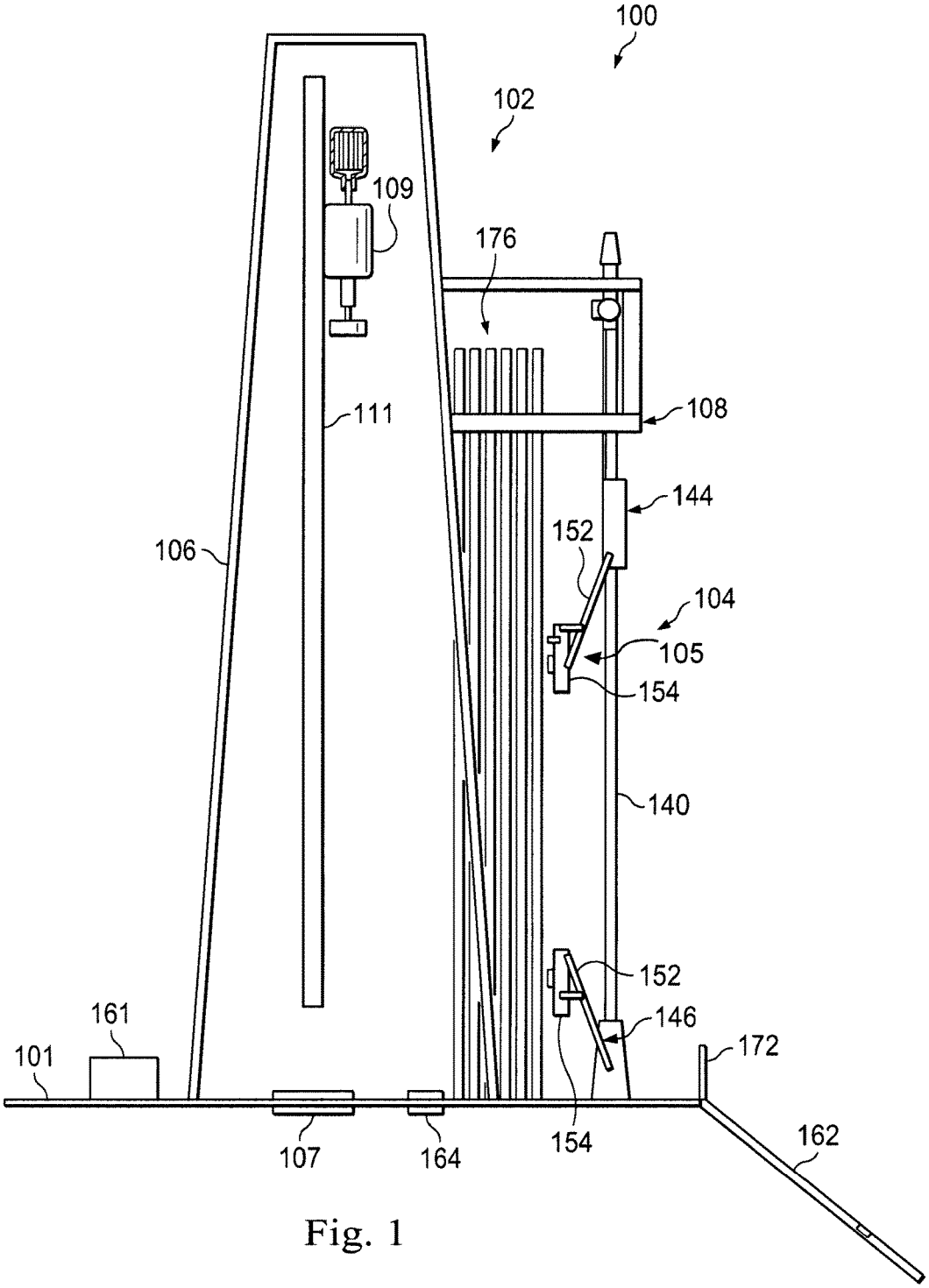
FIG. 1 is a schematic of an exemplary drilling rig according to one or more aspects of the present disclosure.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The systems, devices, and methods described herein relate to a drilling rig apparatus that includes a modular racker system. The modules of the racker system connect together and disconnect in a manner that simplifies the setup and the tear down of the racker system when the drilling rig apparatus is to be moved to a new location. The modules may be moved as a part of the drilling rig apparatus from one drilling location to another drilling location, or may be moved from one drilling rig apparatus to a separate other drilling rig apparatus. Since the racker apparatus comprises modules, the setup and tear down may be accomplished in a minimal amount of time, decreasing down time required between moves. In addition, because the racker system is modular, one module may replace a worn or unusable module in a minimal amount of time, without requiring extensive disassembly of a whole racker system. This may reduce the amount of time required for repairs and, likewise, may increase productivity.

This disclosure discusses components that are permanently fixed together to form a module of the racker system. As used herein, the term "permanently fixed" means that the components are mechanically fixed or maintained together as an assembly and are intended to stay fixed or maintained together during assembly, disassembly, and/or operation of the racker system or drilling rig. The components may be in either direct contact or indirect contact. The term "permanently fixed" does not mean that the components are unable to be disassembled for other purposes such as repair of worn or broken elements, for permanent takedown, cleaning, refurbishing, recycling, or other purposes.

FIG. 1 is a schematic of a side view an exemplary drilling rig apparatus 100 according to one or more aspects of the present disclosure. In some examples, the drilling rig apparatus 100 may form a part of a land-based, mobile drilling rig. The drilling rig apparatus 100 may have a drillfloor size of about 35×35 feet, although larger and smaller rigs are contemplated. In some embodiments, the drilling rig apparatus 100 may have a drillfloor size of less than approximately 1540 square feet. In other embodiments, the drilling rig apparatus 100 may have a drillfloor size of less than approximately 1720 square feet.

The drilling rig apparatus 100 shown in FIG. 1 includes rig-based structures 102 and a modular racker system 104 that operates on the rig-based structures 102. The rig-based structures 102 include, for example, a foundational chassis or rig frame (not shown), a mast 106, and a v-door 172 into the drilling rig apparatus 100. The v-door 172 may be arranged to receive tubulars or stands introduced to the drilling rig apparatus 100. In an embodiment, the mast 106 is disposed over and about well-center 107 and supports a plurality of drilling components of a drilling system, shown here as a top drive 109 and its components disposed and moveable along a support column 111. Other drilling components are also contemplated.

This embodiment includes an offline mousehole 164 that may be used to assemble tubulars into stands at a location spaced apart from the well-center 107 so as to not interfere with drilling at the well-center 107. In some embodiments, the mousehole 164 is located above a shallow hole below a rig floor 101 that is offline from well-center 107, where individual tubulars may be assembled together into stands, e.g. a plurality, such as three tubulars together that are then racked in the fingerboard 108 for later use or storage. The racker system 104 is described in greater detail below.

A rig control system 161 may control the racker system 104 and other rig components, while also communicating with sensors disposed about the drilling rig apparatus 100. The rig control system 161 may evaluate data from the sensors, evaluate the state of wear of individual tubulars or stands, and may make recommendations regarding validation of tubulars for a particular use as a part of a drilling operation. In some embodiments, the rig control system 161 may be disposed on the rig floor 101, such as in a driller's cabin, may be disposed in a control truck off the rig floor 101, or may be disposed elsewhere about the drilling site. In some embodiments, the rig control system 161 is disposed remote from the drilling site, such as in a central drill monitoring facility remote from the drill site.

A catwalk 162 forms a part of the drilling rig apparatus 100 and may be directly attached to or disposed adjacent the rig floor 101. The catwalk 162 allows the introduction of drilling equipment, and in particular tubulars or stands, to the v-door 172 of the drilling rig apparatus 100. In some embodiments, the catwalk 162 is a simple, solid ramp along which tubulars may be pushed or pulled until the tubular can be grasped or secured by the upper tubular interfacing element 105 of the racker system 104. In other embodiments, the catwalk 162 is formed with a conveyer structure, such as a belt-driven conveyer that helps advance the tubulars toward or away from the drilling rig apparatus 100. Other embodiments include friction reducing elements, such as rollers, bearings, or other structures that enable the tubulars to advance along the catwalk toward or away from the v-door 172. It should be noted that where land rigs utilize catwalks, offshore rigs utilize conveyors to transport tubulars from the pipe deck to the rig floor 101. Therefore, it should be understood that description of the present disclosure use in a land rig may also be utilized in an offshore rig.

Figure 2:
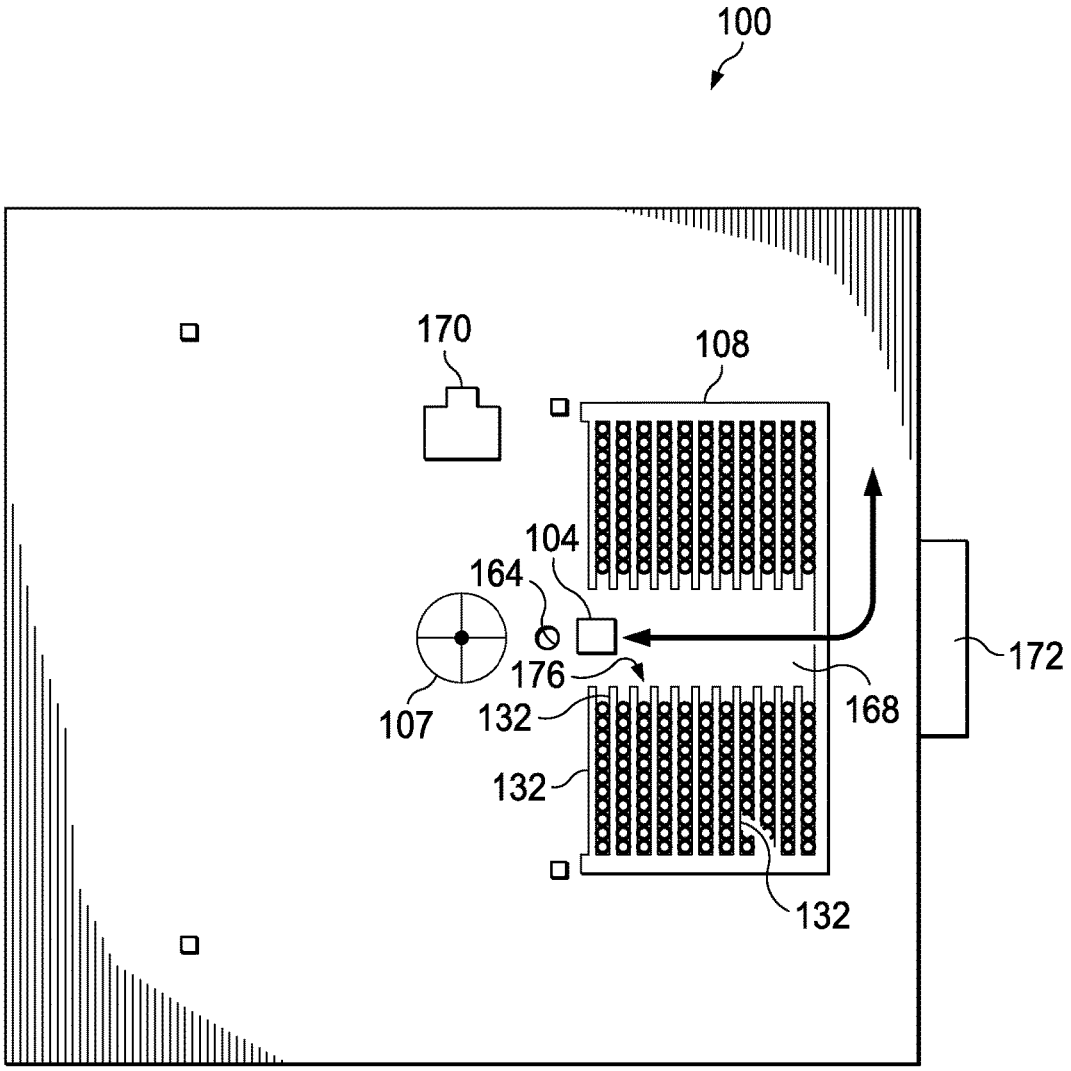
FIG. 2 is a schematic of top view of an exemplary drilling rig according to one or more aspects of the present disclosure.

FIG. 2 is a schematic of top view of the exemplary drilling rig apparatus 100 according to one or more aspects of the present disclosure. FIG. 2 illustrates the fingerboard 108 and other portions of the racker system 104, the stands 176, fingers 132 forming a part of the fingerboard 108, an iron roughneck 170, the mousehole 164, and the well-center 107, all as generally described above. The iron roughneck 170 may be used to connect and disconnect tubulars or stands at either or both of the well-center 107 and the mousehole 164. A passageway 168 may extend between opposing sides of the fingerboard 108 between the v-door 172 and the well-center 107. The racker system 104 may travel along the passageway 168 indicated by the arrow in FIG. 2 to manipulate tubulars or stands between the fingerboard 108, the mousehole 164, the well-center 107, and the v-door 172, and it may travel laterally to a position, such as a parking position, out of the passageway and out of the pathway between well-center 107 and the v-door 172.

Figure 3:
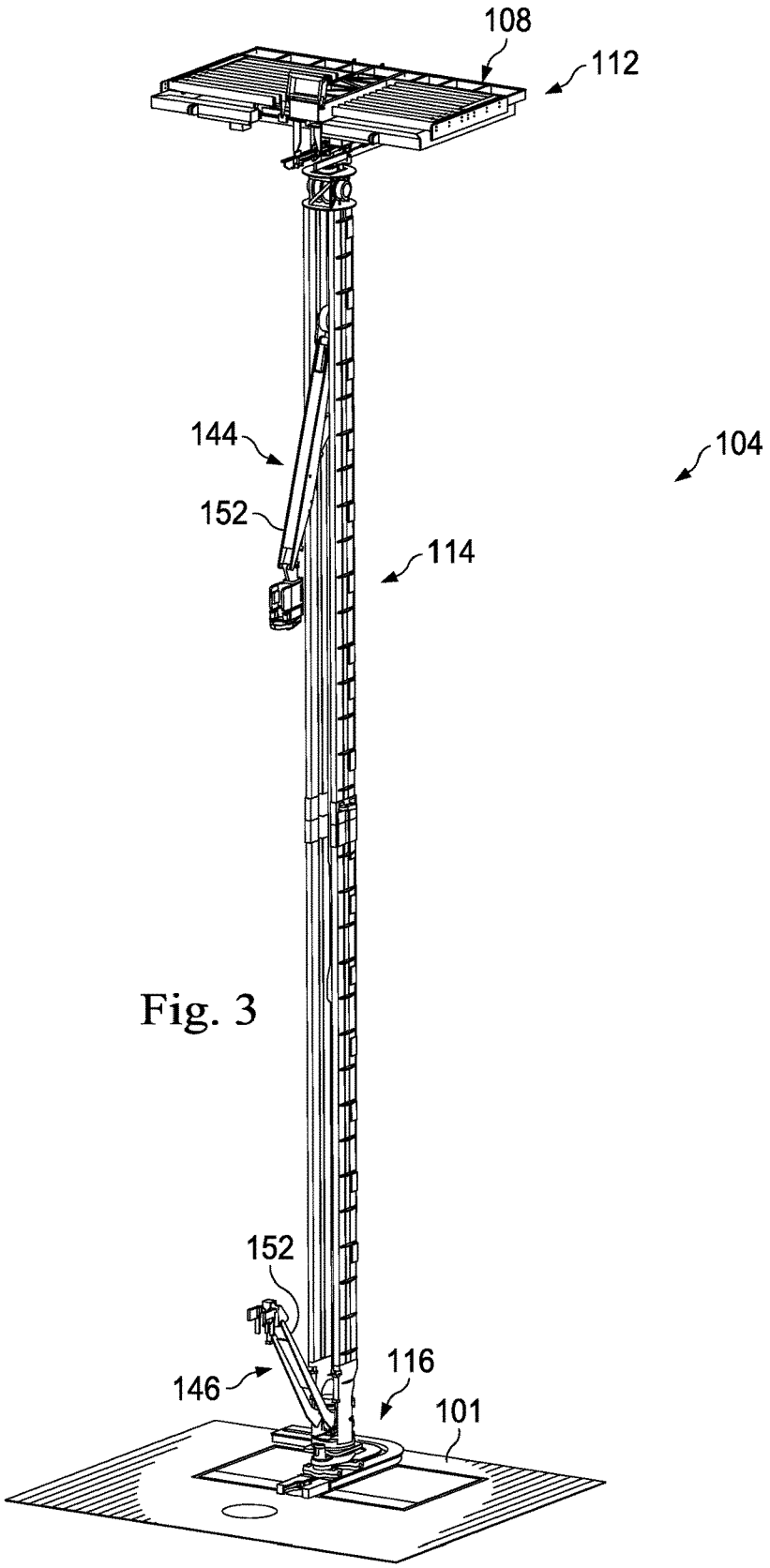
FIG. 3 is a schematic of an isometric view of an exemplary racker system according to one or more aspects of the present disclosure.
Figure 4:
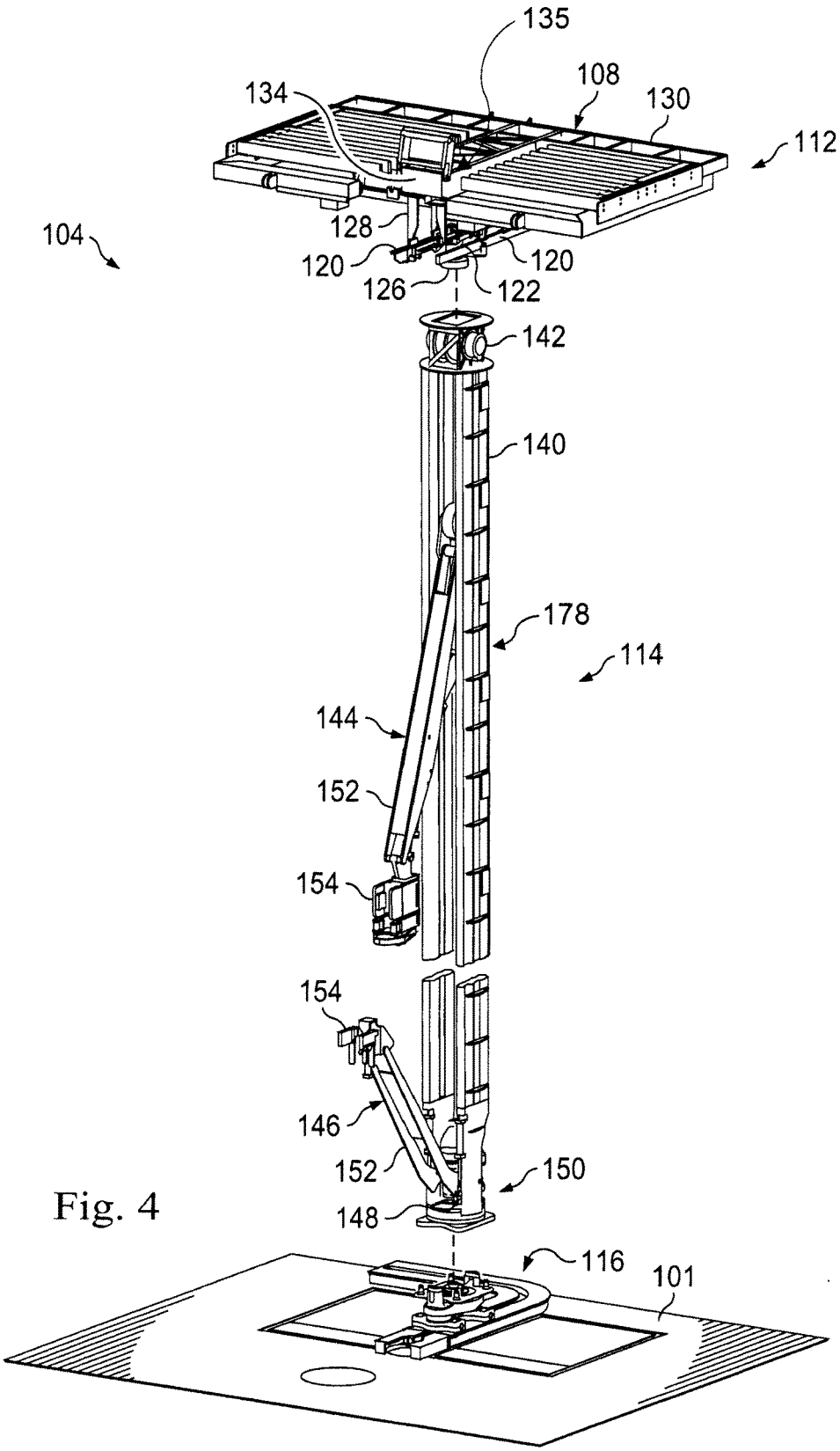
FIG. 4 is a schematic of an exploded isometric view of the exemplary racker system showing exemplary modules according to one or more aspects of the present disclosure.

FIGS. 3 and 4 show the racker system 104 in greater detail. They include an upper track module 112, a racker column module 114, and a lower track module 116. In FIG. 3, the upper track module 112, the racker column module 114, and the lower track module 116 are shown connected in place for operation, while FIG. 4 shows the upper track module 112, the racker column module 114, and the lower track module 116 in an exploded condition. The modules may be separated from one another for transport to a new location while still substantially maintaining their own respective assembled states. In some embodiments, however, the modules may still require some level of packing or unpacking, such as folding or collapsing to a more compact state for transport, and unfolding or extending for reuse. Because of this, the modules may also be easily and quickly interchanged with other similar modules, such as by including quick release components to attach and retain modules to each other, and quick connectors to permit simple "plug n' play" with electrical and hydraulic connectors. This may help expedite repairs, because a replacement module may be introduced in place of an older worn or broken module, and the worn or broken module may be removed and entirely fixed offline while the new module is used to keep the racker system 104 and the drilling rig apparatus 100 in operation. In another embodiment, the replacement module is swapped in during transport of the modules from one rig or rig site to another.

Figure 5:
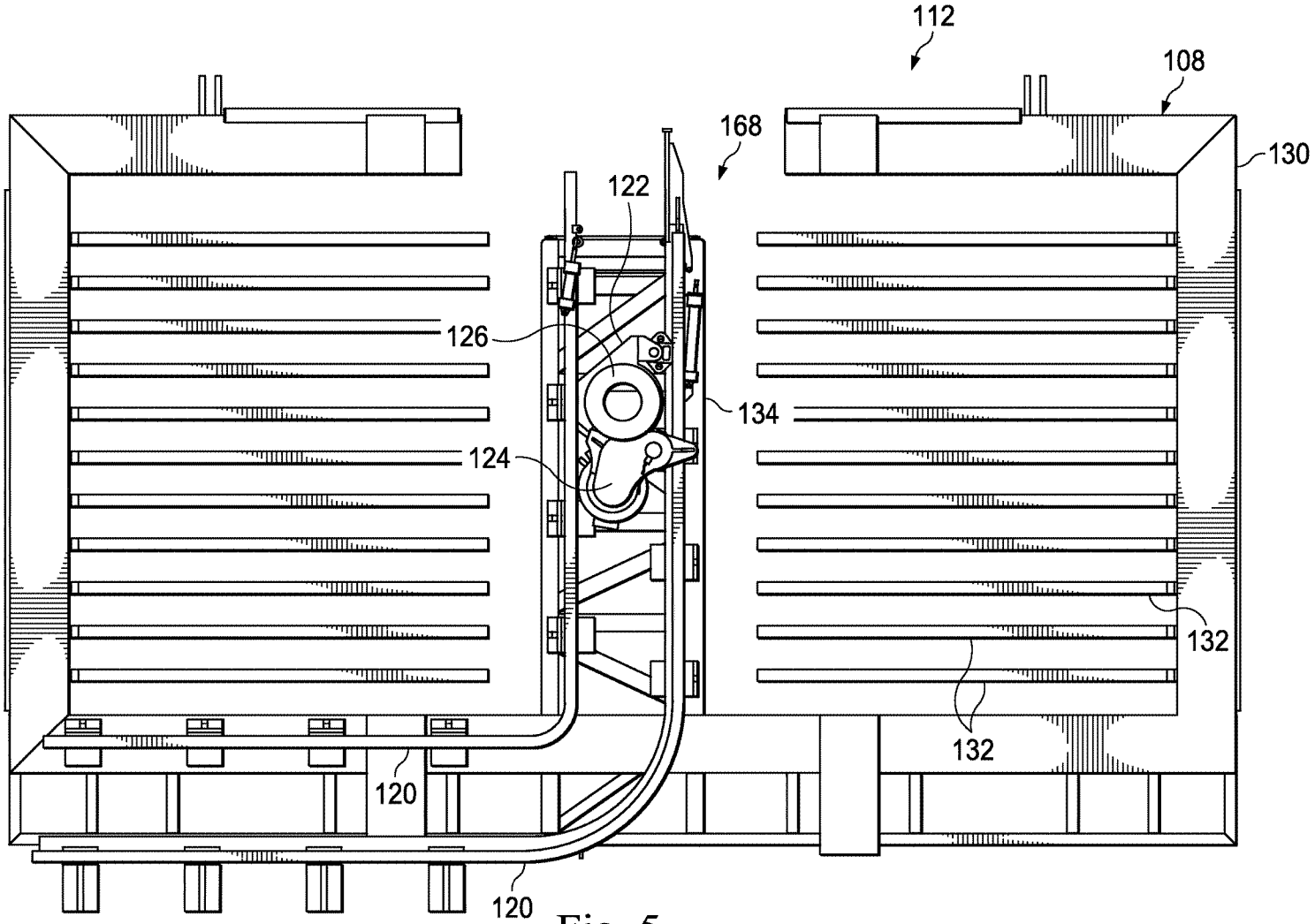
FIG. 5 is a schematic of a bottom plan view of an upper track module of the exemplary racker system of FIG. 4 according to one or more aspects of the present disclosure.

Referring now to FIGS. 4 and 5, the upper track module 112 includes, for example, the fingerboard 108, upper rails 120, an upper carriage that includes an upper cart housing 122 and an upper cart drive 124, a rotational union 126 for the column structure, and a festoon system 128.

The fingerboard 108 is a holding or storage area for stands that have been or will be used to build the drill string. These stands may be stored in the fingerboard 108 until they are used or broken down for removal from the drilling rig apparatus 100. The fingerboard 108 includes an outer support frame 130 having a plurality of individual fingers 132 extending in a parallel direction and cantilevered from the support frame 130. The upper portions of the stands may be inserted between the fingers 132 and thereby held in place, in a substantially vertical position for storage. As can be seen, in this embodiment, the fingerboard 108 includes a left side and a right side, with the passageway 168 therebetween. Support structure 134 extends from the support frame 130 along the passageway 168 and supports the upper rails 120. In some embodiments, the fingerboard 108 of the upper track module 112 is arranged and configured to attach to and be supported by the mast 106 (FIG. 1). In some examples, it is cantilevered from the mast and extends over a portion of the drilling rig floor 101. Other embodiments include a support structure, such as a derrick that supports the fingerboard 108, and the upper rack module 112.

The upper rails 120 are, in this exemplary embodiment, suspended from the support structure 134 of the fingerboard 108 and form an upper track for the upper cart housing 122. The upper rails 120 are permanently fixed to the fingerboard 108, and therefore are not disconnected from the fingerboard 108 during rig assembly, disassembly, or during transport. Accordingly, when the fingerboard 108 is attached to the mast 106, there is little or no additional work or effort required to assemble and attach the upper rails 120. The upper rails 120 extend along the passageway 168 (FIG. 2) between opposing sides of the fingerboard between the v-door 172 and well-center 107. In the embodiment shown, the upper rails 120 curve or extend to a position outside the passageway 168 so that the upper cart housing 122 can travel to a position that may be used to park the racker column module 114 to the side of the pathway 168 between the v-door and well center. Accordingly, the upper rails 120 in this embodiment form an L-shape. Here, there are two upper rails 120, however, other embodiments include additional or fewer rails, or include other structures such as the upper track.

The upper cart housing 122 is securely connected to the upper rails 120 and moves along the upper rails 120 via the upper cart drive 124. In some embodiments, the upper cart housing 122 is permanently fixed to the upper rails 120, and therefore is not disconnected from the upper rails 120 during rig assembly, disassembly, or during transport. In such embodiments, when the fingerboard 108 is attached to the mast 106, there is little or no additional work or effort required to assemble and attach the upper cart housing to the upper rails 120. In the embodiments shown, the upper cart housing 122 is arranged to carry the upper cart drive 124 and the rotational union 126. In this embodiment, the upper cart housing 122 includes wheels and bearings enabling it to travel along the upper rails 120, under the power of the upper cart drive 124. Other embodiments have the upper cart drive 124 displaced from the upper cart housing 122, and the upper cart housing 122 is driven by a belt, chain drive, conveyor, or other system that is powered by the upper cart drive 124 to move the upper cart housing 122 along the upper rails 120. In some embodiments, the upper cart drive 124 is a motor arranged to move the upper cart housing 122 along the upper rails 120.

The upper cart housing 122 of the upper track module 112 is configured to move the upper portion of the racker column module 114 along the upper rails 120. The upper cart housing 122 may include rollers, sliding pads, or other structures that facilitate movement of the racker column module 114 between the v-door 172, mousehole 164, and well-center 107 below the mast 106. In some embodiments, the upper cart housing 122 is a part of a chain structure that drives the racker column module 114 along the passageway 168 formed to accommodate the racker column module 114 through the fingerboard 108.

The upper cart housing 122 carries the rotational union 126, which engages the racker column module 114. This rotational union 126 is configured to removeably attach to the racker column module 114. A festoon system 134 is attached to and extends along the upper rails 120 and it is configured to carry one or more electrical, hydraulic, or other cables, hoses, and wires 135 for the operation of the upper track module 112, the racker column module 114, and the lower track module 116. Depending on the embodiment, one, two, or all of the upper cart drive 124, the rotational union 126, and the festoon system 134 are permanently fixed to the fingerboard 108, and therefore are not disconnected from the fingerboard 108 during rig assembly, disassembly, or during transport.

The racker column module 114, shown in FIG. 4, includes a column 140, a hoisting system 142, a middle arm assembly 144, a lower arm assembly 146, a housing 148, and a motor and braking system 150. The racker column module 114 extends between and connects with the upper track module 112 and the lower track module 116. Depending on the embodiment, one, two, three, four or all of the hoisting system 142, the middle arm assembly 144, the lower arm assembly 146, the housing 148, and the motor and braking system 150 are permanently fixed to the column 140 or a portion of the column, and therefore are not disconnected from the column 140 or a portion of the column during rig assembly, disassembly, or during transport.

The column 140 of the racker column module 114 provides rigidity and support to the racker system 104, provides structural support of the middle and lower arm assemblies 144, 146, and connects the upper track module 112 to the lower track module 116. The column 140 may be formed of a single solid beam or a plurality of beams joined together end to end. In some embodiments, the column 140 includes two parallel plates, spaced apart to hold the middle and lower arm assemblies 144, 146 therebetween.

In this example, the hoisting system 142 is disposed at the top end of the column 140 and receives electric or hydraulic operating power from cables or hoses carried on the upper track module 112. The hoisting system 142 may include a cable extending to the middle arm assembly 144 and may be used to raise and lower the middle arm assembly 144 along the column 140.

The middle arm assembly 144 slides vertically along the column 140 and may be extended or manipulated to grasp the upper end of tubulars, carry, move or otherwise displace a tubular. In some embodiments, the middle arm assembly 144 may move upward or downward on rollers, slide pads, or other elements disposed on the column 140 or carried on the middle arm assembly. The lower arm assembly 146 is, in the exemplary embodiment shown, pivotably attached in place on the lower portion of the column 140.

Each of the middle arm assembly 144 and the lower arm assembly 146 includes a manipulator arm 152 and a gripper head 154. The gripper heads 154 may be sized and shaped to open and close and to grasp or retain tubing, such as tubulars or stands. The manipulator arms 152 may move the gripper heads 154 toward and away from the column 140.

The middle arm assembly 144 and the lower arm assembly 146 are configured to reach out to insert a drill pipe stand into or remove a drill pipe stand from fingerboard 108. That is, they extend outwardly from the column 140 to clamp onto or otherwise secure a drill pipe stand that is in the fingerboard 108 or to place a drill pipe stand in the fingerboard 108. In addition, the middle arm assembly 144 and the lower arm assembly 146 are configured to reach out to receive tubulars introduced to the drilling rig apparatus 100 through the v-door 172 and to carry tubulars or stands from the v-door 172 or the fingerboard 108 to the mousehole 164 or to the well-center 107 for hand-off to the drilling elements, such as the top drive 109. As indicated above, the middle arm assembly 144 may move vertically up and down along the racker column 140. In some aspects, it is operated by the hoisting system 142.

Figure 8:
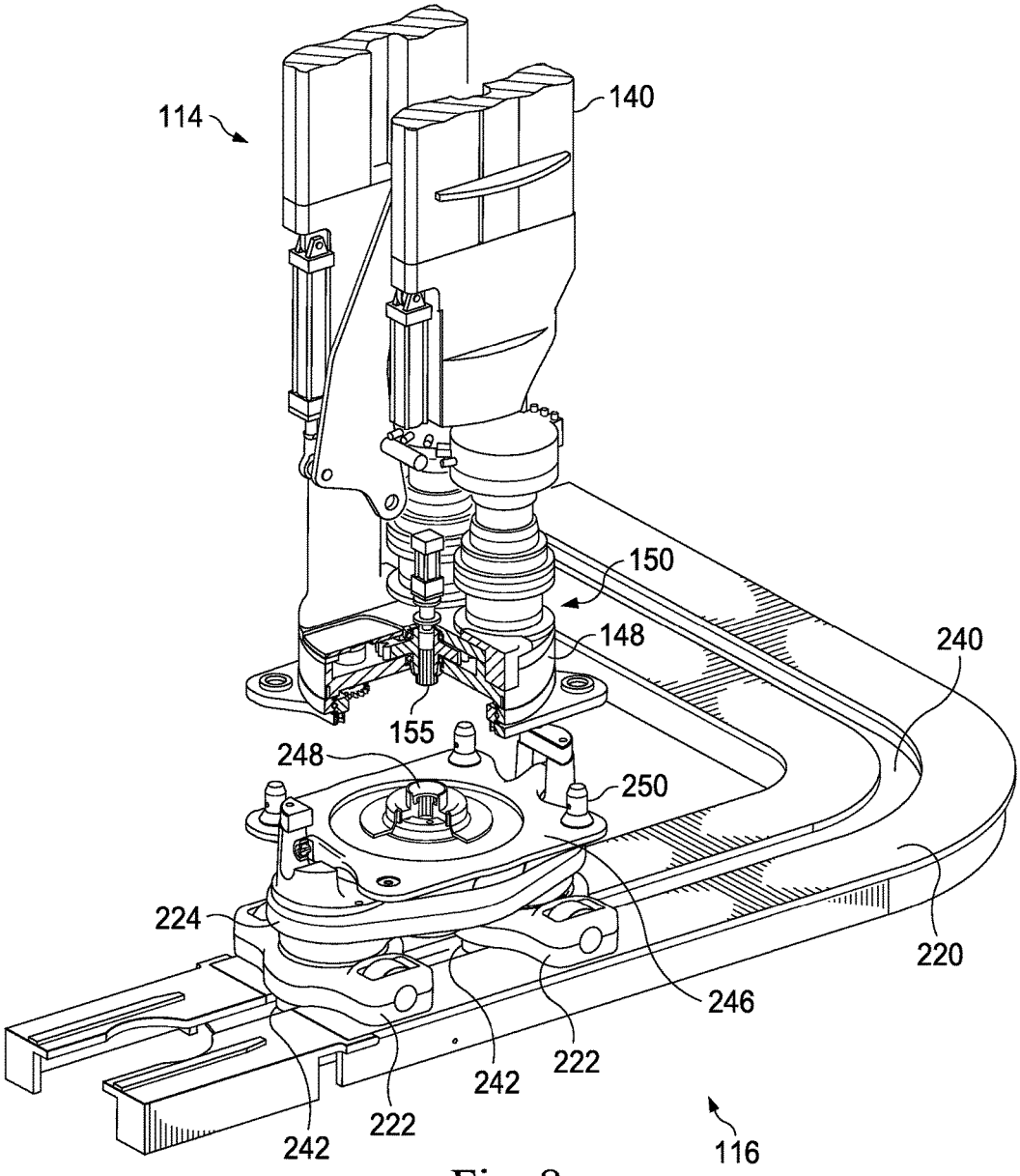
FIG. 8 is a perspective view of a lower track module and a portion of a racker column module of the exemplary racker system of FIG. 4 according to one or more aspects of the present disclosure.

The housing 148 forms the lower portion of the column assembly 114. The housing 148 carries the weight of the racker column 140 and, as is described further herein with reference to FIG. 8, interfaces with the lower track module 116. The housing 148 can be seen best in FIGS. 4 and 8, and is arranged to provide a secure foundation for the racker column module 114. With reference to FIG. 8, the housing 148 includes a gear driven transmission system with a projecting pinion gear 155 that is configured to interface with the lower track module 116. The housing 148 also provides a powered rotational capacity to rotate the column 140 about its axis. Accordingly, during use, while the housing 148 may not rotate, the column 140 may be arranged to spin in order to accomplish desired tasks.

The motor and braking system 150 is, in the exemplary embodiments shown, carried on the housing 148 and is configured to rotate the projecting pinion gear 155. It does this through the transmission system in the housing 148 and powers a lower carriage forming a part of the lower track module as is described herein. It is also configured to rotate, through the same or a separate portion of the transmission system, the column 140. In this embodiment, the motor and braking system 150 is disposed as a part of the racker column module 114. It powers the lower carriage through the interface between the racker column module 114 and the lower track module 116. The motor and braking system 150 may include one or more of an electric motor, a hydraulic motor, or other motor that is arranged to turn the projecting pinion gear 155 and drive the lower track module 116. In some embodiments, the motor is powered by the hoses or cables extending along the upper track module 112, and by additional hoses or cables extending downwardly along the column 140. Depending on the embodiment, these hoses or cables are respectively permanently fixed to the column 140 or the festoon system 134, and therefore are not disconnected from the column 140 or the festoon system 134 during rig assembly, disassembly, or during transport. Accordingly, in this example, power to drive the motor and braking system 150 is obtained via connections made between the upper track module 112 and the racker column module 114. It should be understood that multiple motors, types of motors, and/or pinion gears can be used. Since the motor and braking system 150 provides power to the lower carriage, in some embodiments, there are no separate cables or hoses connected to the lower track module 116.

Figure 6:
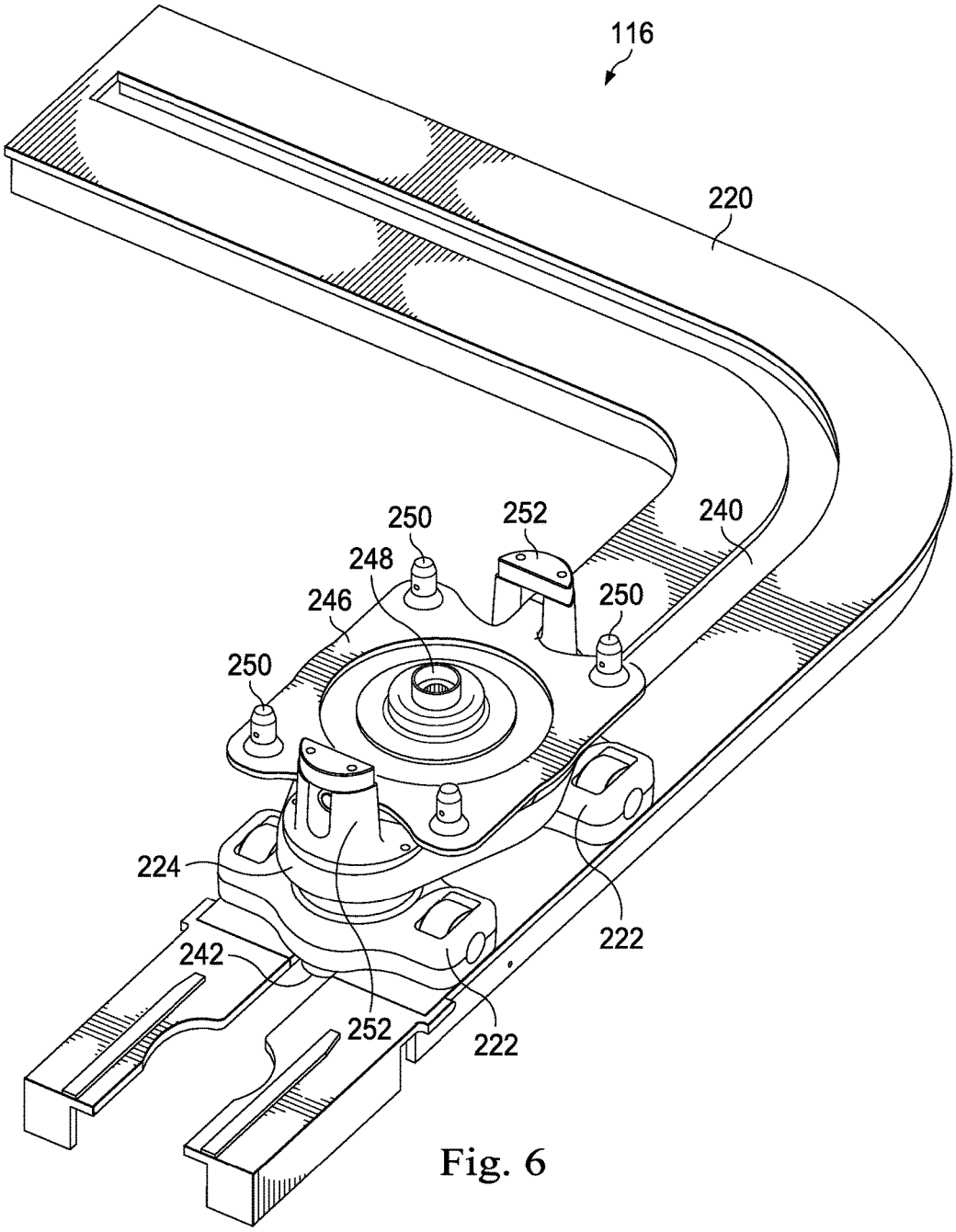
FIG. 6 is a schematic of a perspective view of a lower track module of the exemplary racker system of FIG. 4 according to one or more aspects of the present disclosure.

The lower track module 116, best shown in FIGS. 4 and 6, forms and includes at least a part of the rig floor 101 (FIG. 1). In this exemplary embodiment, the lower track module 116 includes a rig floor portion with a lower track 220 and a lower carriage including a pair of wheel yokes 222 and a lower trolley 224. In the exemplary embodiment shown, the lower track 220 is formed of a floor structure having a longitudinal gap 240 formed therein. The lower track 220 is permanently fixed to a portion of the rig floor 101, and therefore is not disconnected from the portion of the rig floor 101 during rig assembly, disassembly, or during transport. Accordingly, when the portion of the rig floor 101 is installed on the rig support structure (such as a rig frame, chassis, trusses, etc.), there is little or no additional work or effort required to assemble and attach the lower track 220.

Figure 10:
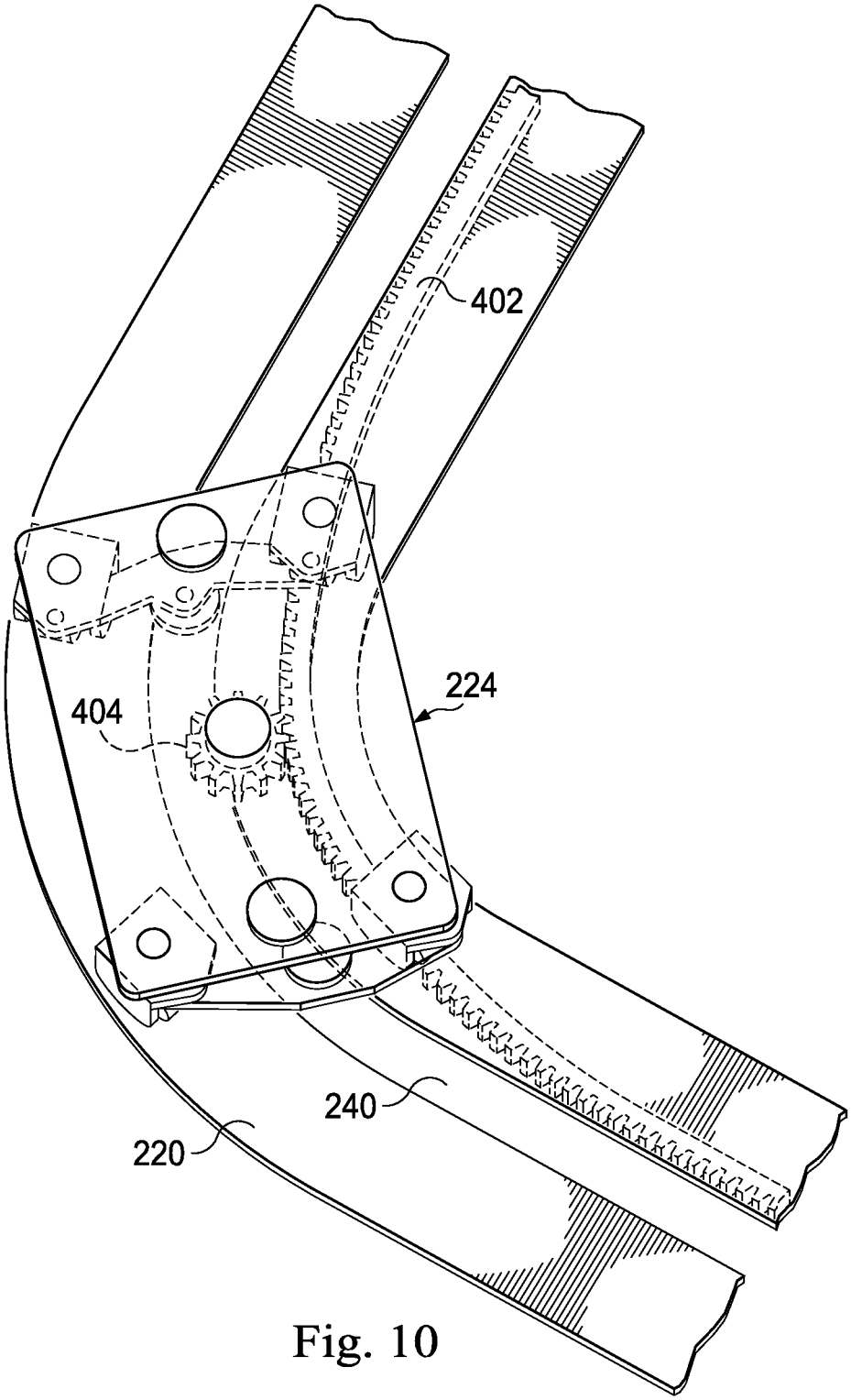
FIG. 10 is a perspective view of a portion of an exemplary lower track module of an exemplary racker system according to one or more aspects of the present disclosure.

The walls or sides of the gap 240 in the lower track 220 guide the direction and movement of the lower trolley 224 as it advances along the track 220. In this example, at least one of the wheel yokes 222 or the lower trolley 224 includes a projecting element (not shown) that is arranged to extend into the gap 240 and maintain the direction of movement. FIG. 10 shows an exemplary lower track portion with a different lower carriage disposed thereon. In this embodiment, the lower track 220 comprises a gear rack 402 along its underside that extends along the gap 240 and is properly spaced from the gap 240 to engage a gear 404 that extends from the lower trolley 224 of the lower carriage. With the gear rack 402 on the underside of the lower track 220, the upper surface of the lower track 220 and also the rig floor can be maintained relatively flat. The gear rack in this embodiment is permanently fixed to the lower track, which is permanently fixed or otherwise forms a part of the rig floor. Additional details regarding the exemplary gear rack on the underside of the lower track 220 is shown in U.S. patent application Ser. No. 14/279,986, filed May 16, 2014, titled "Parking System for a Pipe Racker on a Drilling Rig", expressly incorporated herein in its entirety by express reference thereto.

The wheel yokes 222 forming a part of the lower carriage are configured to extend over and along the gap 240 in the lower track 220. In this embodiment, there are two wheel yokes 222, with each having a protruding guide 242 that extends into the gap 240. As the wheel yokes 222 advance along the lower track 220, the protruding guide maintains the wheel yokes 222 on course. In some embodiments, the wheel yokes 222 extend through the gap 240 in the lower track 220 and extend under the solid lower track 220 in a manner that mechanically prevents removal from the lower track 220. Thus, the wheel yokes 222 may be mechanically connected to the lower track 220 in a manner that allows them to be transported together without disassembly.

The lower trolley 224 forming a part of the lower carriage rests on and is carried by the wheel yokes 222. It is configured to be disposed directly under the racker column module 114 and to carry the weight of the racker column module 114. Accordingly, the column module 114 may interface with the lower trolley 224 and may provide power from the motor and braking system 150 to drive the lower trolley 224 along the lower track 220. In this embodiment, the lower trolley 224 includes an extending pinion gear that engages the rack gear (not shown) disposed on the underside of the lower track 220 and rotates to advance the racker column module 114, carried by the wheel yokes 222, along the lower track 220. As best seen in FIG. 6, the lower trolley 224 includes a support surface 246 and a central receiving recess 248 that is arranged to interface with the projecting pinion gear 155 (FIG. 8) of the housing 148. Connectors, shown here as upwardly projecting posts 250, are shaped and configured to be received in corresponding openings in the housing 148 to connect the lower trolley 224 of the lower track module 116 to the housing 148 of the racker column module 114. Stabilizers 252 also provide structural support to prevent rotation of the lower trolley 224 and the housing 148.

Depending on the embodiment, the wheel yokes 222, the lower trolley 224, or any other element of the lower carriage are permanently fixed to the lower track 200, and therefore are not disconnected from the lower track during rig assembly, disassembly, or during transport.

Figure 7:
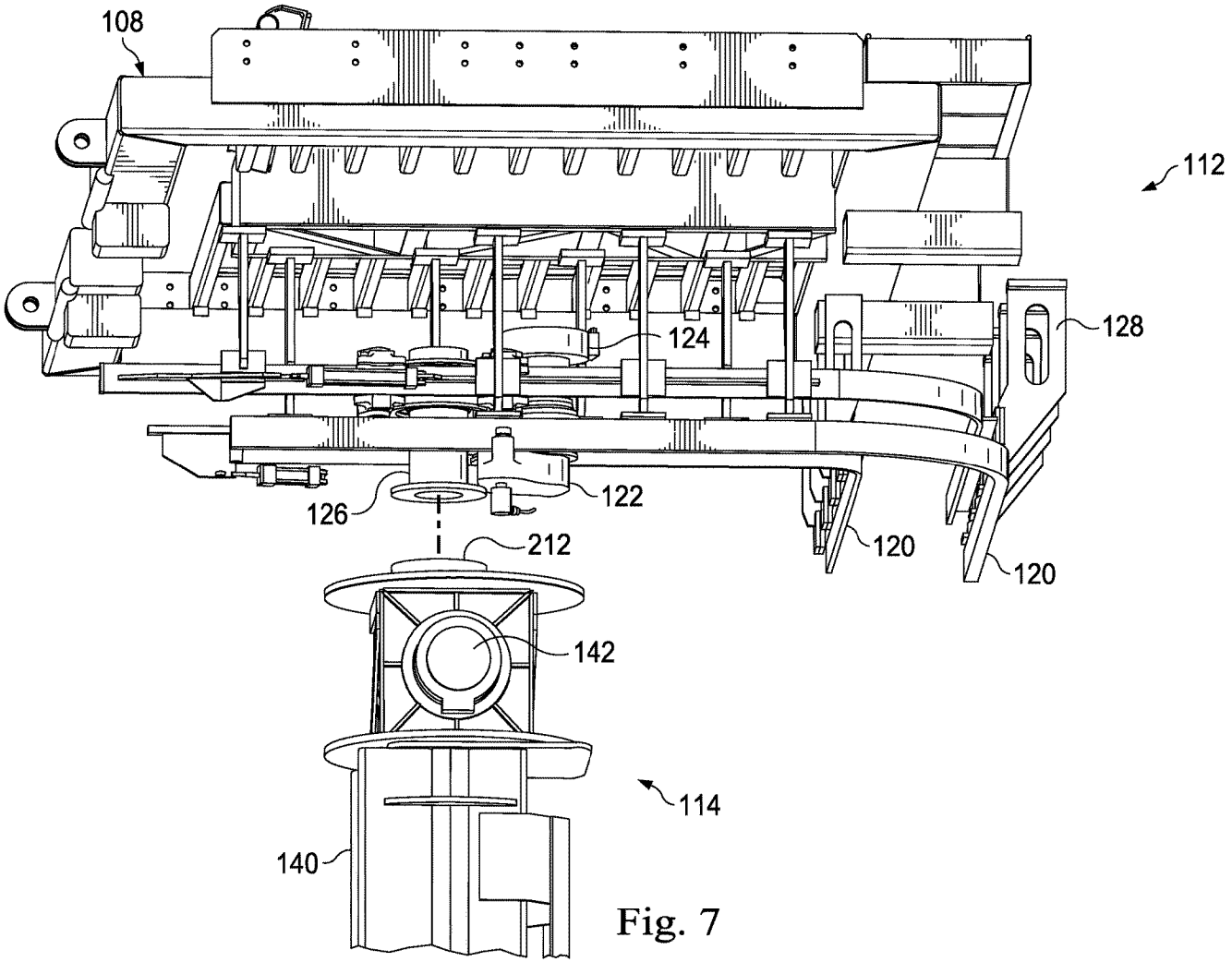
FIG. 7 is a perspective view of an upper track module and a portion of a racker column module of the exemplary racker system of FIG. 4 according to one or more aspects of the present disclosure.

FIGS. 7 and 8 show the interfacing components of the upper track module 112, the column module 114, and the lower track module 116. Referring first to FIG. 7, the hoisting system 142 at the upper end of the column 140 includes an engagement structure 212 that connects with the rotational union 126. In the embodiment shown, the rotational union 126 may be stabbed into a receiving portion of the engagement structure 212 to mechanically connect the upper track module 112 and the racker column module 114. In other embodiments, the engagement structure 212 or other engagement structure is stabbed into the upper carriage forming a part of the upper track module 112. This physical connection permits the column 140 to rotate around its axis while connected to and carried by the upper cart housing 122. Accordingly, when the upper cart housing 122 is powered to drive along the upper rails 120, the top portion of the racker column module 114 is carried along the upper rails 120 also. In some embodiments, the hoisting system 142 is disposed elsewhere along the racker column module 114 and the interface between the modules occurs directly with the column 140 and the upper track module 112. In some embodiments, the hoisting system 142 forms a part of the upper track module 112 and is used to hoist the middle arm assembly 144 during operation.

The interfacing connection between the upper track module 112 and the column module 114 are selectively attachable so that during operation they are fixed together, yet can be disconnected from each other so that each module may be separately removed from the drilling rig apparatus 100 during disassembly and then separately transported to a new location. Alternatively, they may be disassembled and replaced with a separate module in the event of repair or maintenance.

FIG. 8 shows the interface between the racker column module 114 and the lower track module 116 ready to be connected together. During assembly, the projecting pinion gear 155 carried on the housing 148 is stabbed into the central receiving recess 248, and the posts 250 are aligned with and received in the corresponding receiving holes in flanges of the housing 148. The connection may be secured with additional bolts, pins, or other elements. For example, pins may be inserted through receiving holes in the posts 250 to prevent the racker column module from inadvertently separating from the lower carriage. In an exemplary embodiment, quick connect/release fasteners are used for rapid exchange of modules. With the projecting pinion gear 155 extending into the lower trolley 224, a gear system in the lower trolley 224 can be used to drive a corresponding pinion gear (not shown) extending through the gap 240 of the lower track 220. The corresponding pinion gear may be engaged with a gear rack on the underside of the lower track 220. Accordingly, as the motor and braking system 150 rotates the projection pinion gear 155, the projecting pinion gear 155 rotates a corresponding gear on the lower trolley 224 to advance the lower trolley 224 and the attached wheel yokes 222 along the lower track 220.

Figure 9:
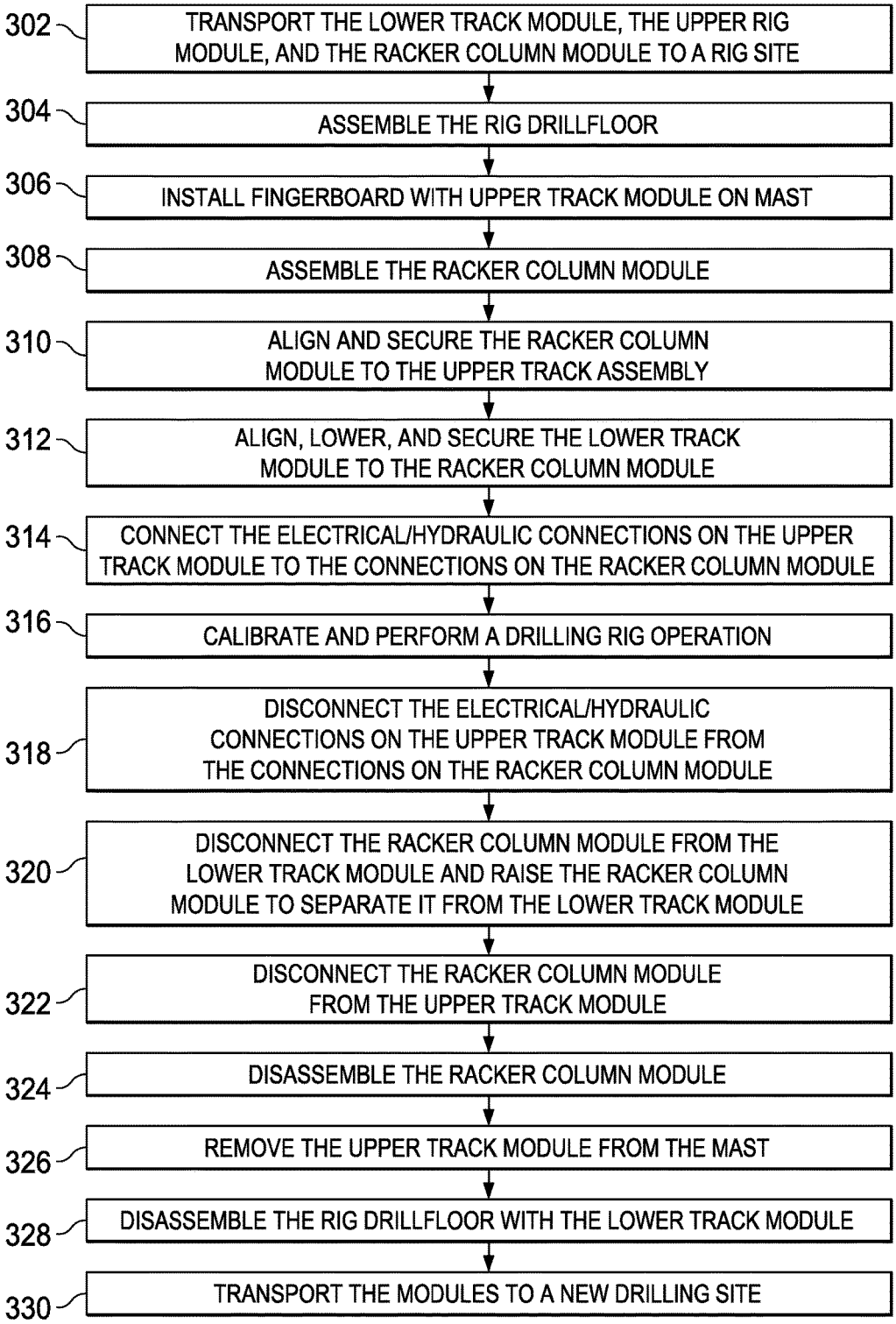
FIG. 9 is an exemplary flowchart of a process for assembling and disassembling a modular racker system according to one or more aspects of the present disclosure.

FIG. 9 shows an exemplary method of assembling and disassembling a modular racker system, such as the racker system 104 for use on the drilling rig apparatus 100. The method begins at 302 and includes transporting the upper track module, the lower track module and the racker column module to a drill site. Since the lower track module includes the rig drillfloor with the lower track and the upper track module includes the upper racker track assembled with the fingerboard, transporting these components in an assembled state reduces transport loading and unloading time, and as set forth herein, may increase operational efficiency by reducing rig setup and teardown times.

At 304, the rig floor is assembled. This may include laying out and securing the rig drillfloor sections to a structural chassis or frame forming the rig foundation of the drilling rig apparatus 100. Since sections of the rig drillfloor include the lower track, and in some embodiments, the lower carriage, including the wheel yokes 222 and the lower trolley 224, the lower track module 116 is installed and in position when the rig drillfloor is installed. In addition, the lower carriage may be installed when the rig drillfloor is installed.

At 306, the upper track module is raised above the rig drillfloor and attached to the rig mast. This might include supporting the fingerboard via a connection to the mast so that the fingerboard cantilevers away from the mast. Since the upper track is attached to the fingerboard, the upper track is also set up and supported by the mast when the upper track module is attached to the mast. Thus, the fingerboard and the upper track are setup together at the same time.

At 308, the racker column module is assembled or setup on the ground. This may include connecting components, arranging, or otherwise setting up the racker column module. Since some embodiments of the racker column module include electrical/hydraulic cables or hoses 178 (as shown in FIG. 4) already permanently fixed and in place on the racker column, efficiencies in assembly of the racker column module can be achieved.

At 310, the racker column module 114 is aligned with and secured to the upper track module 112. In the exemplary embodiment described herein, this includes connecting the rotational union 126 to a top portion of the racker column module 112 so that the racker column module 114 can rotate relative to the upper track module 112. In some embodiments, this includes stabbing in the column module 112 to components of the upper track module 112, such as the upper drive cart 124, the rotational union 126, or other structure forming a part of the upper carriage. Stabbing the column module 112 may include raising or lifting all or a portion of the racker column module 112 above the rig drillfloor.

At 312, the lower track module 116 is aligned with and secured to the racker column module 114. This may include stabbing a portion of one of the racker column module and the lower track module into the other so that they are mechanically connected and securely attached to one another. In some examples, this includes aligning the lower carriage under the racker column module 114 while the racker column module 114 is raised and stabbed into the upper carriage. Accordingly, with the racker column module 114 above the drill rig floor, the lower carriage is aligned along the lower track to be under the racker column module, and the racker column module is lowered onto the lower carriage. In embodiments described herein, lowering the racker column module onto the lower carriage includes stabbing the projection pinion gear 155 into a central receiving recess 248 in the lower trolley 224 so that power from the racker column module may be transmitted to the lower track module.

At 314, electrical or hydraulic connections are made to connect the upper track module to the racker column module. Since in the exemplary embodiment described, the hoses or cables already form a part of the upper track module and the racker column module, there is no need to run the hoses and cables during the assembly process. In some embodiments, the hoses and cables provide electric or hydraulic power to the motor and braking system 150, the housing 148, and the middle and lower arm assemblies 144, 146 on the racker column module 114. With this arrangement, connections need only be made at one location to connect (or to disconnect) to the upper and lower track modules. In some embodiments, it also provides electrical or hydraulic power to the lower track module through the racker column module. In embodiments where the lower track module requires electrical or hydraulic connection, those connections may also be made to connect hoses or cables that make up a portion of the respective modules.

At 316, the assembled racker system 104 is used to perform a drilling rig operation, such as manipulate tubulars, makeup or breakdown stands, or perform other functions.

When desired, the racker system 104 may be disassembled for transportation to a new drill site. This process is in many respects simply the reverse of the setup process, and not all steps or elements are repeated in the same level of detail as above. Disassembly however may begin at 318 by disconnecting the electrical or hydraulic connections on the upper track module from the connections on the racker column module.

At 320, the racker column module is disconnected from the lower track module by raising the racker column module to separate it from the lower carriage, and the lower carriage or the racker column module may be moved so that the carriage is not under the racker column module. At 322, the racker column module is disconnected from the upper track module. This may include lowering the racker column module so that the interfering structure that was stabbed into the upper column module is removed from the upper column module. At 324, the racker column module is disassembled for transport. At 326, the upper track module is removed from the mast by removing the fingerboard and lowering it to the ground and preparing it, with the lower track and other upper track module components, for transport. At 328, the drill rig floor is disassembled into sections, with the lower track forming a part of at least one of the drillfloor sections. At 3320, the modules are transported to a second drill site for reassembly onto a drilling rig. Since the modules are transported in an assembled or a partially assembled state including with attached electrical cables and/or hydraulic hoses, the assembly and disassembly of the drilling rig apparatus may be expedited, resulting in more efficient, and therefore less expensive, rig operations.

While the modules described herein have certain components associated therewith, it should be understand that the modules may be arranged so that different components form a part of different modules. For example and without limitation, the motor and braking system 150 carried on the racker column module may alternatively be carried on the lower track module. Other components may be likewise redistributed depending on the racker device arrangement. In addition, not all modules have all the components identified in the exemplary racker disclosed herein. For example, some rackers may have fewer arm assemblies than what are disclosed here. Likewise, because of its length, some embodiments of the racker column module 114 may be broken down further, for example, with a first module including a column portion and the middle arm assembly and a second module including a column portion and the lower arm portion, with the arm portions still attached to and forming a part of the column during assembly, disassembly, or transport.

In view of all of the above and the figures, one of ordinary skill in the art will readily recognize that the present disclosure introduces a drilling rig apparatus that includes a transportable lower track module comprising a drilling rig floor comprising a lower track arranged and configured to accommodate a lower carriage. The lower track may be permanently fixed to the drilling rig floor so as to form a part of the drilling rig floor and being transportable as part of the drilling rig floor. A racker column is operably attachable to the lower carriage track module. A transportable upper track module includes a fingerboard and an upper track arranged and configured to accommodate an upper carriage moveable along the upper track. The upper track is permanently fixed to the fingerboard and is transportable in a connected configuration. The upper track module is operably attachable to the racker column.

In an aspect, the racker column forms a part of a racker column module that also comprises an arm assembly permanently fixed to the racker column and a hoisting system arranged to raise and lower the arm assembly along the racker column. In an aspect, the lower track module comprises a lower carriage attached to and moveable along the lower track, the lower carriage comprising a portion extending through the lower track in a manner that retains the lower carriage in place on the lower track during transportation. In an aspect, the upper track of the upper track module and the lower track of the lower track module each have a portion forming an L-shape. In an aspect, the upper track module comprises an upper carriage permanently fixed to and moveable along the upper track, the upper carriage being connected to the upper track in a manner that retains the upper carriage in place on the lower track during transportation. In an aspect, the racker column forms a part of a racker column module comprising a motor and braking system arranged to power the lower carriage of the lower track module when operably connected thereto. In an aspect, the lower track module includes the lower carriage permanently fixed to the lower track. The lower carriage includes a support surface configured to support the racker column, and one of a projecting gear and a receiving recess. The racker column forms a part of a racker column module including the other of the projecting gear and the receiving recess. The projecting gear is arranged to fit within the receiving recess connecting the rack column module and the lower carriage.

In another aspect, the present disclosure introduces a drilling rig apparatus that includes a transportable lower track module comprising a portion of a drilling rig floor comprising a lower track arranged and configured to accommodate a lower carriage. The lower track is permanently fixed to a part of the drilling rig floor and is transportable as a part of the drilling rig floor. A transportable racker column module is selectively attachable to the lower carriage track module. The racker column module comprises a racker column and an arm assembly permanently fixed to the column and arranged to manipulate a tubular. A transportable upper track module includes a fingerboard and an upper track arranged and configured to accommodate an upper carriage moveable along the upper track. The upper track module is permanently fixed to the fingerboard and comprises a connector element configured to couple with the racker column module.

In an aspect, the lower track module comprises a lower carriage permanently fixed to and moveable along the lower track, the lower carriage comprising a portion extending through the lower track in a manner that retains the lower carriage in place on the lower track during transportation. In an aspect, the upper track of the upper track module and the lower track of the lower track module each have a portion forming an L-shape. In an aspect, the upper track module comprises an upper carriage permanently fixed to and moveable along the upper track, the upper carriage being connected to the upper track in a manner that retains the upper carriage in place on the lower track during transportation. In an aspect, the racker column module comprises a hoisting system permanently fixed to the column and a second arm assembly moveable with the hoisting system. In an aspect, the racker column module comprises a motor and braking system permanently fixed to the column and arranged to power the lower carriage of the lower track module when operably connected thereto.

In another aspect, the present disclosure introduces a method of modifying a rig which comprises: installing a lower track module on a drilling rig apparatus, the lower track module comprising a lower track permanently fixed to a drilling rig floor, the lower track arranged and configured to accommodate a lower carriage; connecting a racker column to the lower track module in a manner that a lower carriage transports the racker column along the lower track; and connecting an upper track module to the racker column, the upper track module comprising a fingerboard permanently fixed to upper track that is arranged and configured to accommodate an upper carriage moveable along the upper track in a manner that an upper carriage of the upper track module transports the racker column along an upper track of the upper track module.

In an aspect, connecting the racker column to the lower track module comprises connecting a racker column module that includes extendable arms for grasping a tubular to the lower track module. In an aspect, the method includes connecting one or more electrical cables or hydraulic hoses of the racker column to an electrical cable or hydraulic hose of the upper track module. In an aspect, the racker column forms a part of a racker column module, and wherein connecting an upper track module to the racker column comprises stabbing a component carried by one of the upper track module and the racker column module into the other of the upper track module and the racker column module. In an aspect, the racker column forms a part of a racker column module, and wherein connecting the racker column to the lower track module comprises stabbing a component carried by one of the racker column module and the lower track module into the other of the racker column module and the lower track module. In an aspect, the method includes disconnecting the upper track module from the racker column; disconnecting the lower track module from the racker column; and transporting the lower track module and the upper track module to a new location with the lower carriage connected to the lower track and with the upper carriage connected to the upper track. In an aspect, the racker column forms a portion of a racker column module, and the method further comprises driving the lower carriage along the track with a motor forming a part of the racker column module.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A drilling rig apparatus, comprising:

a lower track module comprising a drilling rig floor, a lower track permanently fixed to the drilling rig floor, and a lower carriage permanently fixed to and moveable along the lower track, wherein the lower carriage does not include any motor;

an upper track module comprising a fingerboard, an upper track permanently fixed to the fingerboard, and an upper carriage permanently fixed to and moveable along the upper track; and a racker column operably attachable to and detachable from both the lower carriage of the lower track module and the upper carriage of the upper track module, wherein, when the racker column is attached to both the lower carriage and the upper carriage, the racker column is moveable along the lower track and the upper track to thereby move the racker column relative to the drilling rig floor;

wherein a motor and braking system is permanently affixed to the racker column to allow the lower carriage of the lower track module to be driven along the lower track when the racker column is operably attached to the lower carriage; and wherein the lower track module, the racker column, and the upper track module are transportable independently of each other.

2. The drilling rig apparatus of claim 1, wherein the racker column forms a part of a racker column module that also comprises an arm assembly permanently fixed to the racker column and a hoisting system arranged to raise and lower the arm assembly along the racker column.

3. The drilling rig apparatus of claim 1, wherein the lower track module comprises the lower carriage attached to and moveable along the lower track, the lower carriage comprising a portion extending through the lower track in a manner that retains the lower carriage in place on the lower track during transportation.

4. The drilling rig apparatus of claim 1, wherein a portion of the upper track is curved and a portion of the lower track is curved.

5. The drilling rig apparatus of claim 1, wherein the upper carriage is connected to the upper track in a manner that retains the upper carriage in place on the lower track during transportation.

6. The drilling rig apparatus of claim 1, wherein the racker column forms a part of a racker column module that includes the motor and braking system.

7. The drilling rig apparatus of claim 1, wherein the lower carriage comprises:

a support surface configured to support the racker column; and one of a projecting gear and a receiving recess, wherein the racker column forms a part of a racker column module comprising the other of the projecting gear and the receiving recess, the projecting gear being arranged to fit within the receiving recess connecting the rack column module and the lower carriage.

8. The drilling rig apparatus of claim 1, wherein a curved portion of the upper track extends through a passageway formed between two opposing sides of the fingerboard to a position outside of the passageway.

9. A drilling rig apparatus, comprising:

a transportable lower track module comprising a portion of a drilling rig floor, a lower track permanently fixed to a part of the drilling floor, and a lower carriage permanently fixed to and moveable along the lower track, wherein the lower carriage does not include any motor;

a transportable upper track module comprising a fingerboard, an upper track permanently fixed to the fingerboard, an upper carriage permanently fixed to and moveable along the upper track; and a transportable racker column module selectively attachable to and detachable from both the lower carriage of the lower track module and the upper carriage of the upper track module, wherein the transportable racker column module comprises a racker column an arm assembly permanently fixed to the racker column and arranged to manipulate a tubular, and a motor and braking system permanently affixed to the racker column;

wherein, when the transportable racker column module is attached to both the lower carriage and the upper carriage, the transportable racker column module is moveable along the lower track and the upper track to thereby move the transportable racker column module relative to the drilling rig floor;

wherein the motor and braking system allows the transportable racker column module to drive the lower carriage of the lower track module along the lower track when the transportable racker column module is operably attached to the lower carriage; and wherein the lower track module, the racker column module, and the upper track module are separate and distinct and transportable independently of each other.

10. The drilling rig apparatus of claim 9, wherein the lower carriage comprises a portion extending through the lower track in a manner that retains the lower carriage in place on the lower track during transportation.

11. The drilling rig apparatus of claim 9, wherein each of a curved portion of the upper track and a curved portion of the lower track forms an L-shape.

12. The drilling rig apparatus of claim 9, wherein the upper carriage is connected to the upper track in a manner that retains the upper carriage in place on the lower track during transportation.

13. The drilling rig apparatus of claim 9, wherein the racker column module comprises a hoisting system permanently fixed to the column and a second arm assembly moveable with the hoisting system.

14. The drilling rig apparatus of claim 9, wherein the lower carriage comprises:

a support surface configured to support the racker column; and one of a projecting gear and a receiving recess, wherein the transportable racker column module comprises the other of the projecting gear and the receiving recess, the projecting gear being arranged to fit within the receiving recess connecting the transportable rack column module and the lower carriage.

15. A method comprising:

disassembling at a first drill site a modular racker system into three separate and distinct modules in their own respective assembled states, wherein the three separate and distinct modules include a lower track module, a racker column module, and an upper track module, the lower track module comprising, in an assembled state, a drilling rig floor, a lower track permanently fixed to the drilling rig floor, and a lower carriage permanently fixed to the lower track, and the upper track module comprising, in an assembled state, an upper track, a fingerboard permanently fixed to the upper track, and an upper carriage permanently fixed to and moveable along the upper track;

transporting the three separate and distinct modules to a second drill site while the three separate and distinct modules substantially maintain their own respective assembled states; and reassembling the modular racker system onto a drilling rig at the second drill site by attaching the racker column module to both the lower track module and the upper track module, wherein transporting the three separate and distinct modules in their own respective assembled states expedites reassembly of the modular racker system.

16. The method of claim 15, wherein reassembling the modular racker system comprises:

connecting the racker column module to the lower track module, wherein the racker column module includes extendable arms for grasping a tubular to the lower track module.

17. The method of claim 16, wherein reassembling the modular racker system further comprises:

connecting one or more electrical cables or hydraulic hoses of the racker column module to an electrical cable or hydraulic hose of the upper track module.

18. The method of claim 15, wherein connecting the upper track module to the racker column module comprises stabbing a component carried by one of the upper track module and the racker column module into the other of the upper track module and the racker column module.

19. The method of claim 15, wherein connecting the racker column module to the lower track module comprises stabbing a component carried by one of the racker column module and the lower track module into the other of the racker column module and the lower track module.

20. The method of claim 15, wherein disassembling the modular racker system comprises:

disconnecting the upper track module from the racker column module such that the upper carriage remains connected to the upper track;

disconnecting the lower track module from the racker column module such that the lower carriage remains connected to the lower track.

21. The method of claim 15, wherein the method further comprises driving the lower carriage along the track with a motor forming a part of the racker column module.

22. The method of claim 15 further comprising:

disassembling at the second drill site the modular racker system into the three separated modules, wherein the three separated modules substantially maintain their own respective assembled states to expedite transportation of the three separated modules to a new drill site and reassembly of the modular racker system at the new drill site.

23. The method of claim 15, wherein transporting the three separated modules to the second drill site comprises:

transporting the upper track module, the lower track module, and the racker column module to the second drill site, wherein an assembled state of the upper track module includes the fingerboard permanently fixed to the upper track of the upper track module and one or more electrical cables or hydraulic hoses, wherein an assembled state of the lower track module includes at least a portion of the drilling rig floor permanently fixed to the lower track of the lower track module, and wherein an assembled state of the racker column module includes an electrical cable or hydraulic hose permanently fixed to the racker column of the racker column module.

* * * * *